United States Patent [19]

Hardt

[11] Patent Number: 4,703,829

[45] Date of Patent: Nov. 3, 1987

[54] COLLAPSIBLE AND PORTABLE MEGAPHONE

[76] Inventor: Herbert T. Hardt, 220 E. Glendale, Appleton, Wis. 54911

[21] Appl. No.: 837,380

[22] Filed: Mar. 3, 1986

[51] Int. Cl.[4] ..... G10K 11/00

[52] U.S. Cl. ..... 181/178; 181/180

[58] Field of Search ..... 181/21, 22, 177, 178, 181/180, 184

[56] References Cited

U.S. PATENT DOCUMENTS

| | | | |
|---|---|---|---|
| 648,994 | 5/1900 | Porter | 181/178 |
| 673,396 | 5/1901 | Hogan | 181/178 |
| 936,910 | 10/1909 | Kingsley | 181/178 |
| 1,158,871 | 11/1915 | Tomlin | 181/178 X |
| 1,211,584 | 1/1917 | Hooey | 181/178 |
| 1,504,170 | 8/1924 | Weins | 181/178 |
| 1,541,122 | 6/1925 | Dodge et al. | 181/178 |
| 2,517,665 | 8/1950 | Hochstein | 181/178 |
| 2,790,504 | 4/1957 | Hooe | 181/178 |
| 3,450,226 | 6/1969 | Kessler | 181/180 |

*Primary Examiner*—Benjamin R. Fuller

*Attorney, Agent, or Firm*—Andrus, Sceales, Starke & Sawall

[57] ABSTRACT

A megaphone is formed from a self-supporting flexible plastic sheet. The sheet is wrapped with overlapping side edges to form a horn shaped member. The overlapping edges are releasably interlocked by edge slots and interconnecting edge arms. A separate mouthpiece has a tube which telescopes into the narrow mouth end of the horn and has an outer shaped end for coupling to the user's lips. The plastic sheet may be rolled into a compact tubular roll. The mouthpiece is placed over the roll to maintain the rolled configuration for storage and transport. The horn sheets can be readily mass produced by stamping and the mouthpiece by molding.

8 Claims, 5 Drawing Figures

COLLAPSIBLE AND PORTABLE MEGAPHONE

BACKGROUND OF THE PRESENT INVENTION

The present invention relates to a collapsible and portable megaphone and particularly to such a megaphone which is conveniently collapsed for transport and storage.

Megaphones have been used for many years to project the voice of the user. Many megaphones have a generally conically shaped horn configuration, with a relatively small mouth opening which flares outwardly to the outermost broadcast end. Although various powered-type megaphones have been developed, the simplest megaphone merely relies on the horn effect to transmit the sound of the user outwardly from the user.

At public sports events, the spectators voice their approval/disapproval of occurences in play actions on a more or less continuous basis. The "home" field affect is well recognized in sporting events, wherein the home crowd which is generally the largest percentage of the spectators, can effect the outcome by verbally "getting into" the game. Thus, the cheering by the home spectators can psychologically effect the attitude and play of the home team. At such spectator events, one may see spectators forming their programs into a horn shaped configuration to more fully project their voice with that of the other spectators.

Collapsible megaphones of a more particular construction have been suggested in the prior art for many years, and from time to time folding megaphones have probably been commercially available. For example, U.S. Pat. No. 936,910, which issued Oct. 12, 1909 and is entitled Horn, discloses a megaphone which is formed from a relatively flat sheet having inclined side edges. The flat sheet can be wrapped into a horn shaped configuration with the side edges formed with projections and recesses to releasably connect the overlapping side edges and thereby produce a horn affect. The patent particularly discloses a structure which is adapted to have an end fold portion such that the sheet can also be used as a fan structure. The blank sheet is formed with various scored fold lines to provide appropriate folding in interconnection of the several cooperating parts.

These and similar megaphones are found in the prior art. For example, similar devices are also shown in other U.S. Patents.

| U.S. Pat. No. | Inventor | Issue Date |
|---|---|---|
| 648,994 | Porter | 05/08/1900 |
| 936,910 | Kingsley | 10/12/1909 |
| 1,158,871 | Tomlin | 11/02/1915 |
| 1,504,170 | Weins | 08/05/1924 |
| 2,517,665 | Hochstein | 08/08/1950 |
| 2,790,504 | Hooe | 04/30/1957 |

Although various forms of megaphones have been provided, a megaphone of a significant commercial availability has not been located.

The more complicated collapsible megaphones such as shown in U.S. Pat. No. 1,504,170 which issued Aug. 5, 1924 are relatively costly and not particularly adapted to large sports events and the like. Other megaphones such as those shown in U.S. Pat. No. 936,910 which issued Oct. 12, 1909 do not have a mouthpiece for use by the spectator and would appear to be directed to a single use application.

There is a need for a relatively low cost megaphones which can be reused while maintaining the highly effective horn function.

SUMMARY OF THE PRESENT INVENTION

The present invention is particularly directed to a reusable, collapsible megaphone especially constructed with an effective mouthpiece and establishing convenient transport and storage of the collapsed megaphone. Generally in accordance with the present invention, the megaphone is formed from a sheet-like blank of a relatively sturdy self-supporting material such as flexible plastic. The blank is adapted to be wrapped with releasably interconnected side edges to form a megaphone having a frusto-conical horn configuration such as in a conventional voice driven horn. A separate mouthpiece is provided especially configured and having a coupling end releasably secured to the narrow mouth end of the megaphone. The mouthpiece is also specially shaped for optimum coupling to the spectators mouth. The plastic horn blank may be conveniently rolled into a relatively small compact roll for transport and storage. The mouthpiece includes an appropriate central opening and is adapted to be placed over the rolled megaphone blank to maintain the rolled configuration for storage and transport. A plastic megaphone is readily adapted for long usuage and convenient reusuage without distruction or degradation of the horn shape. Further, the horn blanks sheets can of course be readily mass produced as by stamping while the mouthpiece can be conveniently mass produced made as a molded member of a compatible plastic.

The blank edges can of course be formed with suitable interlocking edge configurations. Applicant, however, has found that a particularly desirable releasable interlock is formed by simple edge slots and interconnecting edge arms formed in a flat horn blank.

The megaphone might also be conveniently used in the boating industry. Thus it is often desired to converse with an adjacent boater. Although various radio communication systems are available they do not find wide usage particularly in the very small boat, for the smaller outboard type, and fishing boats because of the expense. Such a usage however demands a compact unit for convenient storage of the megaphone. Further, the materials used must withstand the harsh water environment. In addition, the horn must of course be quickly and conveniently assembled. A device constructed in accordance with the present invention is almost uniquely adapted to such application.

The present invention has been found to provide a relatively inexpensive reusable collapsible megaphone unit which is particularly adapted for mass production and usuage at spectator sports as well as many other applications.

BRIEF DESCRIPTION OF THE DRAWING

The drawing furnished herewith illustrates a preferred construction of the present invention in which the above advantages and features are clearly disclosed as well as others which will be readily understood from the following description of the illustrated embodiments.

In the drawing.

DESCRIPTION OF THE ILLUSTRATED EMBODIMENT

Figure 1:
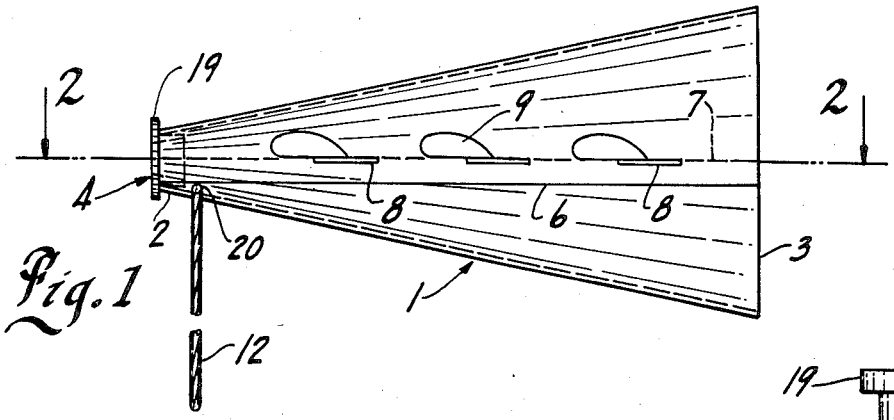
FIG. 1 is a pictorial view of a megaphone incorporating a construction in accordance with the present invention.
Figure 4:
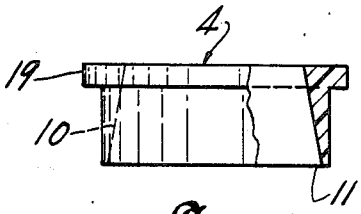
FIG. 4 is a pictorial view of the mouthpiece shown in FIGS. 1 and 2.
Figure 2:
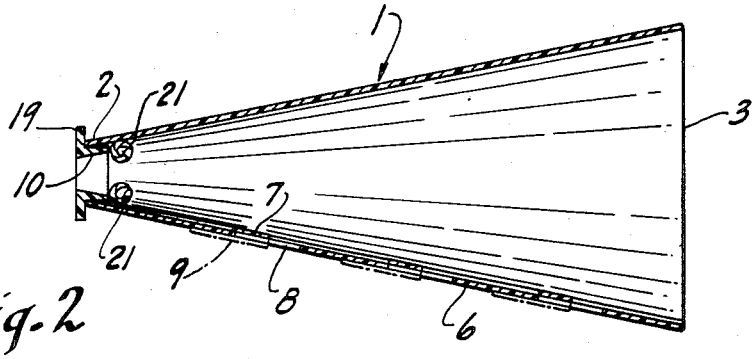
FIG. 2 is a longitudinal cross-sectional view through the megaphone shown in FIG. 1.
Figure 3:
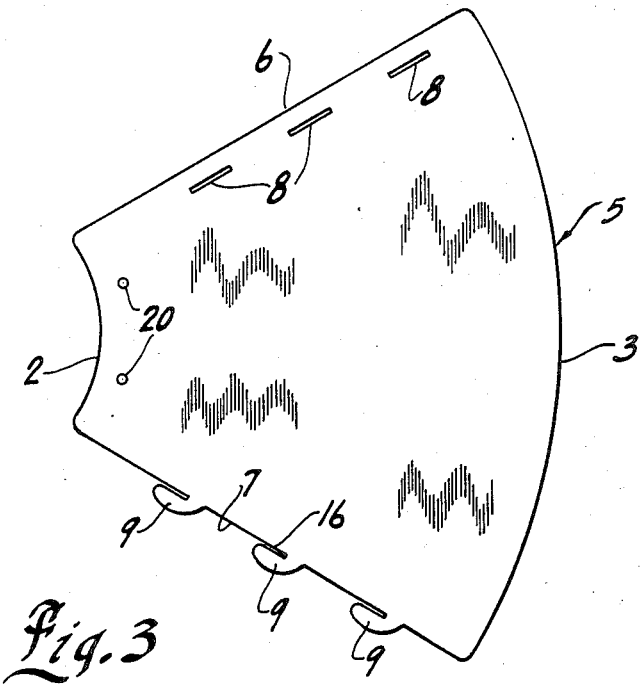
FIG. 3 is a plan view of a blank shaped to permit forming of the horn portion of the megaphone shown in FIGS. 1 and 2.

Referring to the drawing and particularly to FIGS. 1 and 2, a megaphone is illustrated having a horn-shaped portion 1 with a relatively small mouth end 2 and expanding outwardly in a frusto conical configuration, terminating in a large sound transmitting end 3. A separate mouthpiece 4 is releasably secured to the small or mouth end 2 of the horn member. In accordance with the present invention, the horn member is formed from a blank 5, such as shown in FIG. 3. The blank 5 has opposed edges 6–7 with interlocking elements 8–9. The blank 5 may be wrapped into the horn-shape configuration with the edges overlapped and releasably connected by interlocking elements 8–9 to establish and maintain the horn configuration. The mouthpiece 4 is formed as an annular member having the coupling edge or end 10 releasably secured to the small or mouth end 2 of the horn portion 1. The mouthpiece 4 is shown as a molded plastic member having a specially formed tubular end 11 which telescopes into the end of the horn and establishes a frictional inter-engagement of the mouthpiece with the mouth end of the horn. A neck strap 12 is secured to the mouth end of the horn portion for convenient support during the activity. The strap 12 is selected to extend the length of the horn.

Figure 5:
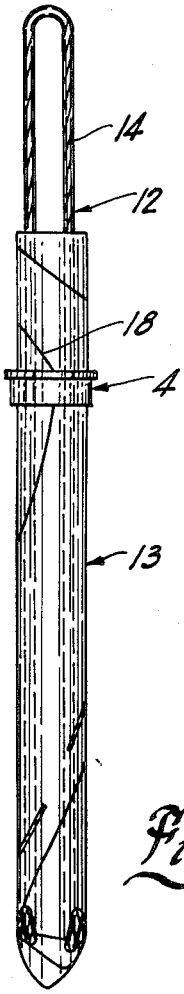
FIG. 5 is a view showing the collapsible megaphone in a folded or collapsed state.

When not used as a megaphone, the mouthpiece 4 is removed and the releasable edges of the horn blanks 5 are disengaged. The blank 5 is rolled into a compact cylindrical member 13 and the mouthpiece is slid over the rolled blank member 13 for storage and transport, as shown in FIG. 5. In the transport positions, the strap 12 is passed through the wrapped cylindrical blank 13 and provides a convenient carrying handle 14.

Thus, the megaphone of the present invention is readily converted between the storage and transport condition or state and the megaphone configuration.

The plastic blank 5 provides a long, reusable life and is particularly adapted to convenient rolling and unrolling while maintaining the integrity of the horn body section.

Similarly the molded plastic mouthpiece 4 can readily be coupled and decoupled to the horn without loss of its integrity or functional purpose, both as the support and as a mouthpiece.

More particularly in a preferred embodiment of the present invention, the megaphone and particularly the horn portion is formed from suitable plastic including polyester, polyethylene tera phthlate and such as Mylar (Trademark of Du Pont) or other suitable material and generally of a 10–15 mil. gauge, or about 12 guage. Such material is readily available in sheet form and may be die cut into the desired blank 5 configuration, as shown in FIG. 3. The relatively heavy guage plastic establishes a long, reusable life. It is however highly flexible and can be conveniently rolled into the compact storage position and subsequently formed into the smooth frustoconically shaped horn. Further, the material permits printing of advertising and information generally, which may of course contribute to the commercial acceptance of the unit.

The blank 5 has a frusto-conical shape, having a narrow, concave end edge defining the mouthpiece end and a wide convex end edge defining the transmitting end. The end edges are connected by straight inclined side edges.

The illustrated releasable edge inter-connecting elements 8–9 have been found to be uniquely adapted to rapid assembly and disassembly of the unit while maintaining a reliable and closed connection, thereby maintaining a highly effective functional sound horn. The element 8 along the first side edge is a plurality of elongated slots. Three slots are shown in equal spaced relation and extending parallel to the blank edge. The interlocking elements 9 are shown as interlocking arms extending parallel to the adjacent side edge and connected thereto at one end by a lateral integral portion 15. The arms 9 are offset from the slot 8 by about ½ the length of the slot. Each arm 9 has a length about equal to the length of a slot and is located in slightly spaced relation to the edge of the blank proper by a slight space or gap 16. The outer edge of each arm is curved as at 17 for convenient assembly with the opposed aligned slot 8.

In use, the blank 5 is unrolled from the storage position of FIG. 3 and wrapped into a generally horn shape. The wrapped blank is slightly deformed longitudinally or axially of the horn to align the arms 9 with the slots 8. The arms 9 are moved into the slots 8 and the deformed blanks released to move the gaps 16 over the edges of the slots and thereby locating the arms 9 into interlocking location with the slots 8, as shown in FIGS. 1 and 2. The blank 5 may be conveniently rolled into a compact, elongated tubular roll, as shown in FIG. 5. In rolling of the blank, the interlocking projecting elements 9 are rolled inside, and the outer corner 18 of the wide edge 3 and the adjacent side edge 6 is located intermediate the roll 13. The mouthpiece 4 is located at the corner 19 and maintains the tubular roll 13.

The mouthpiece 4 is shown as a slightly elongated, tubular member. The mouthpiece has the tubular mounting portion 10 terminating in one end in a flange 19. The flange 19 may be shaped as a flat, slightly dished configuration to which the user's mouth is conveniently applied in use for projecting sound. The flange may also be a simple rolled end portion or the like.

The mouthpiece can of course be conveniently molded of any desired plastic material and in fact formed of the same material as the horn. However, appliant has found that a polystyrene plastic for the mouthpiece provides a particularly economical and low cost combination while maintaining the desired integrity of the mouthpiece even after repeated connections and disconnections from the mouth end of the horn.

As shown in FIGS. 1 and 2, the neck strap 12 is secured to the smaller mouth end of the horn. The strap 12 is illustrated as a simple, flexible cord having the opposite ends extended through openings 20 in diametrically opposite sides of the horn. The inner ends of the cord strap 12 are knotted as at 21 to hold the cords to the horn. The strap 12 may of course be formed of any suitable material and secured to the horn as desired. The strap is preferably formed of a flexible cord or the like and of a length slightly greater than that of the horn. The strap 12 is then conveniently passed back through the horn and projects outwardly thereof for carrying of the collapsed and rolled megaphone apparatus.

In a practical application, the mouthpiece had the coupling portion formed with a length of one inch and a width or diameter of $1\frac{1}{2}$ inches. The outer mouth end was $1\frac{3}{4}$ inches. The megaphone was constructed having a length of 11 inches and a projecting end of $5\frac{1}{2}$ inches and a mouthpiece end which received a $1\frac{1}{2}$ inch mouthpiece portion with sufficient friction to securely support the mouthpiece in place as shown in FIGS. 1 and 2. The megaphone can of course be any appropriate size and the above is typical of a practical unit.

The collapsible and portable megaphone apparatus of the present invention is rapidly unfolded and assembled to a megaphone structure and is also rapidly and conveniently collapsed to a compact form for transport and/or storage. The plastic construction provides for a long, useful life even though folded and folded many times as needed. Further, the plastic construction particularly adapts the megaphone to use in marine environments such as encountered in small and other boating environments.

Various modes of carrying out the invention are contemplated as being within the scope of the following claims particularly pointing out and distinctly claiming the subject matter which is regarded as the inventin.

I claim:

1. A portable collapsible megaphone comprising a horn blank of a self-supporting flexible material in sheet form having a narrow end and a wide end joined by inclined side edges which include releasably connecting interlocking means, said horn blank adapted to be rolled into a tight compact cylindrical member and alternatively adapted to be rolled with the opposing side edges interconnected by said interlocking means to form a smooth frusto-conical horn configuration, said flexibility of said horn blank being selected and constructed to permit repeated rolling and unrolling thereof into said cylindrical member without degradation of the horn configuration, said horn having a small diameter mouth end and a large diameter sound transmitting end, a separate mouthpiece having a central opening, said mouthpiece having means for releasable connection to the small diameter mouth end of said horn, said mouthpiece having an opening at least as great as the diameter of the rolled blank and thereby adapted to be telescoped over the rolled cylindrical blank to maintain said rolled cylindrical configuration for storage and transport.

2. The megaphone of claim 1 wherein said horn blank is formed of a plastic of about 12 guage, said plastic being selected from the group of polyester and polyethylene tera phthlate plastics.

3. The megaphone of claim 1 wherein said mouthpiece includes a tubular portion releasably telescoped to said small diameter mouth end and having an outer enlarged end portion adapted to be operatively engaged by the user's mouth.

4. The megaphone of claim 1 having a flexible strap member secured to the horn blank adjacent the small diameter mouth end, said strap member having a length in excess of said blank and passing through and out of said rolled blank to form a carrying handle for said rolled blank.

5. A megaphone, comprising a horn member having a substantial frusto-conical configuration including a small diameter mouth end, said frusto-conical configuration adapted to be collapsed to a tightly rolled configuration of a rolled cylindrical member, a separate mouthpiece having a releasable connection means for interconnection with the mouth end of said horn, said mouthpiece having a clear opening at least as large as the diameter of the rolled cylindrical member and thereby adapted to be telescoped over the rolled cylindrical member to form a supporting band to maintain said rolled cylindrical member in the rolled configuration for transport and storage.

6. The megaphone of claim 5 having a flexible strap member secured to the horn member adjacent the small diameter mouth end, said strap member having a length in excess of said horn member and passing through and out of said rolled cylindrical member to form a carrying handle for said rolled cylindrical member.

7. The megaphone of claim 5 wherein said mouthpiece includes a tubular portion releasably telescoped to said small diameter mouth end and having an outer enlarged end portion adapted to be operatively engaged by the user's mouth.

8. The megaphone of claim 5 wherein said horn member includes a separating means extended longitudinally of the horn member for opening of the horn member, said horn member being formed of flexible material and adapted to be rolled into said cylindrical member with said separation means opened.

* * * * *